US011090960B2

(12) United States Patent
Naruse et al.

(10) Patent No.: US 11,090,960 B2
(45) Date of Patent: Aug. 17, 2021

(54) POSTURE ADJUSTING APPARATUS AND INKJET IMAGE FORMING APPARATUS

(71) Applicant: KONICA MINOLTA, INC., Tokyo (JP)

(72) Inventors: Akira Naruse, Aichi (JP); Ryo Goto, Tokyo (JP); Kenichi Yamamoto, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/596,847

(22) Filed: Oct. 9, 2019

(65) Prior Publication Data

US 2020/0139732 A1 May 7, 2020

(30) Foreign Application Priority Data

Nov. 2, 2018 (JP) ..... JP2018-207249

(51) Int. Cl.
*B41J 23/00* (2006.01)
*B41J 25/00* (2006.01)

(52) U.S. Cl.
CPC ..... *B41J 25/006* (2013.01)

(58) Field of Classification Search
None
See application file for complete search history.

(56) References Cited

U.S. PATENT DOCUMENTS 5,511,477 A * 4/1996 Adler ..... B41C 1/003 101/128.4
2012/0019577 A1* 1/2012 Izawa ..... B41J 25/3088 347/8
2017/0144463 A1* 5/2017 Kyoso ..... B41J 2/04543
2018/0229520 A1* 8/2018 Murayama ..... B41J 25/316

FOREIGN PATENT DOCUMENTS

JP 2013230643 A * 11/2013
JP 2013230643 A 11/2013

* cited by examiner

*Primary Examiner* — Erica S Lin
*Assistant Examiner* — Tracey M McMillion
(74) *Attorney, Agent, or Firm* — Buchanan Ingersoll & Rooney PC

(57) ABSTRACT

A posture adjusting apparatus includes: an ink ejector that has a detachable inkjet head that ejects ink; and a posture adjuster for adjusting a posture of the ink ejector. The ink ejector includes a head fixing member to/from which the inkjet head is attached and detached, and is movable between a first position where an image is formed on a recording medium by the inkjet head and a second position where the inkjet head is attached and detached, and the posture adjuster allows adjustment of an angle of the head fixing member in the second position.

17 Claims, 15 Drawing Sheets

POSTURE ADJUSTING APPARATUS AND INKJET IMAGE FORMING APPARATUS

CROSS REFERENCE TO RELATED APPLICATIONS

The entire disclosure of Japanese Patent Application No. 2018-207249 filed on Nov. 2, 2018 is incorporated herein by reference in its entirety.

BACKGROUND

Technological Field

The present invention relates to a posture adjusting apparatus and an inkjet image forming apparatus.

Description of Related Art

In recent years, an image forming apparatus using an inkjet printing (hereinafter referred to as an inkjet image forming apparatus) has been widely used as an apparatus for recording high-definition images in various recording media such as paper and fabric. Known inkjet image forming apparatuses include, for example, one that is described in Japanese Patent Application Laid-Open No. 2013-230643 (hereinafter referred to as "PTL 1"), which includes an image forming drum that holds a recording medium on the outer peripheral surface and conveys it, and is provided with a plurality of detachable inkjet heads for forming images by ejecting ink onto a recording medium conveyed by image forming drum.

In the technique described in PTL 1, a carriage for driving the heads can be moved to a maintenance position, and two work doors are provided in positions across the heads moved to the maintenance position, so that the heads can be accessed by the operator from both sides.

On the other hand, the configuration described in PTL 1 has a problem in that the heads are not easily attached and detached for head exchange because the posture of the heads moved to the maintenance position is inclined.

SUMMARY

An object of the present invention is to provide a posture adjusting apparatus and an inkjet image forming apparatus that can improve workability for attaching and detaching heads.

To achieve at least one of the abovementioned objects, according to an aspect of the present invention, a posture adjusting apparatus reflecting one aspect of the present invention comprises:

an ink ejector that has a detachable inkjet head that ejects ink; and a posture adjuster for adjusting a posture of the ink ejector.

To achieve at least one of the abovementioned objects, according to an aspect of the present invention, an inkjet image forming reflecting one aspect of the present invention comprises:

the posture adjusting apparatus described above; and a conveyor disposed in a first position where an image is formed by the inkjet head, the conveyor conveying a recording medium.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
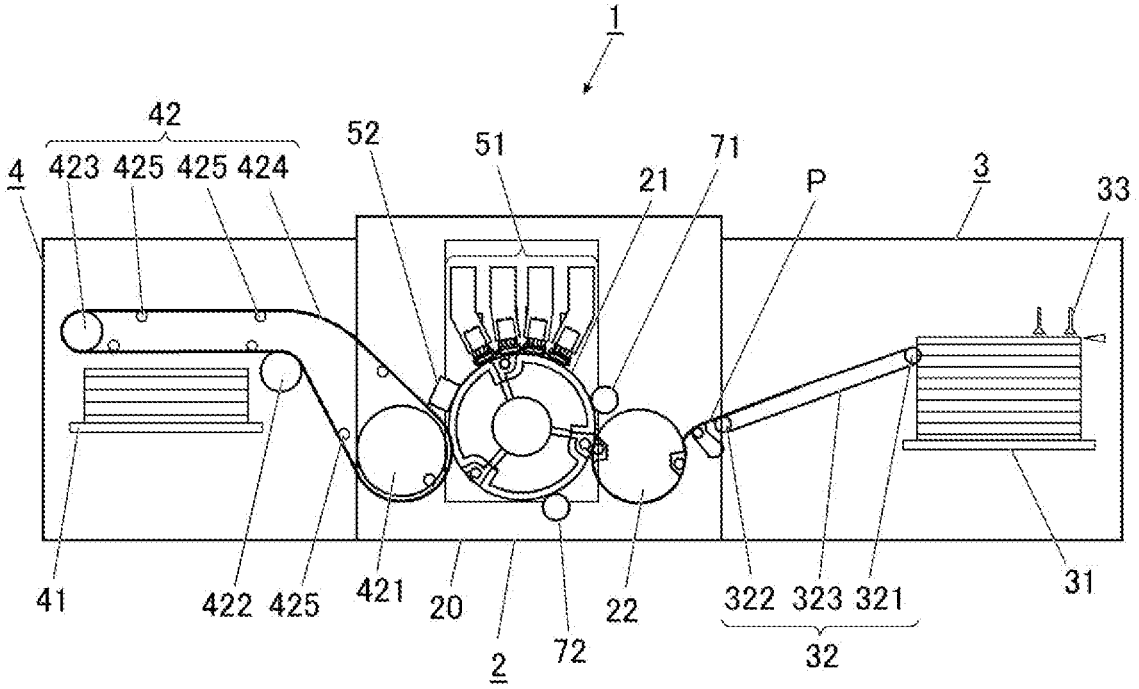
FIG. 1 is a schematic configuration diagram of an inkjet image forming apparatus according to this embodiment.

FIG. 1 is a schematic view showing the internal configuration of inkjet recording apparatus 1 serving as an inkjet image forming apparatus according to this embodiment. As shown in FIG. 1, inkjet recording apparatus 1 of this embodiment includes image forming section 2, sheet feed section 3 that feeds paper to image forming section 2, and collection section 4 that collects recording medium P on which an image is formed by image forming section 2.

Sheet feed section 3 includes sheet feed tray 31 that contains recording medium P, a sheet feed conveyor section 32 that conveys recording medium P from sheet feed tray 31 to image forming section 2, and supply section 33 that supplies recording medium P in sheet feed tray 31 to sheet feed conveyor section 32. Sheet feed conveyor section 32 includes a pair of sheet feed conveyance rollers 321 and 322, and sheet feed conveyance belt 323 is hung around the sheet feed conveyance rollers 321 and 322. Sheet feed conveyance belt 323 takes this recording medium P supplied from sheet feed tray 31 by supply section 33, and conveys this recording medium P to image forming section 2.

Collection section 4 includes container tray 41 that contains recording medium P on which an image is formed, and collection conveyor section 42 that conveys recording medium P from image forming section 2 to container tray 41. Collection conveyor section 42 is provided with a plurality of collection conveyance chain sprockets 421, 422, and 423. Of the plurality of collection conveyance chain sprockets 421 to 423, one collection conveyance chain sprocket 421 is disposed in image forming section 2, and the other collection conveyance chain sprockets 422 and 423 are disposed in collection section 4. Recording medium P on which an image has been formed by image forming section 2 is conveyed while being held on collection conveyance belt 424 through collection claw section 425. When it comes above container tray 41, it is released from collection claw section 425 and contained in container tray 41.

Figure 2:
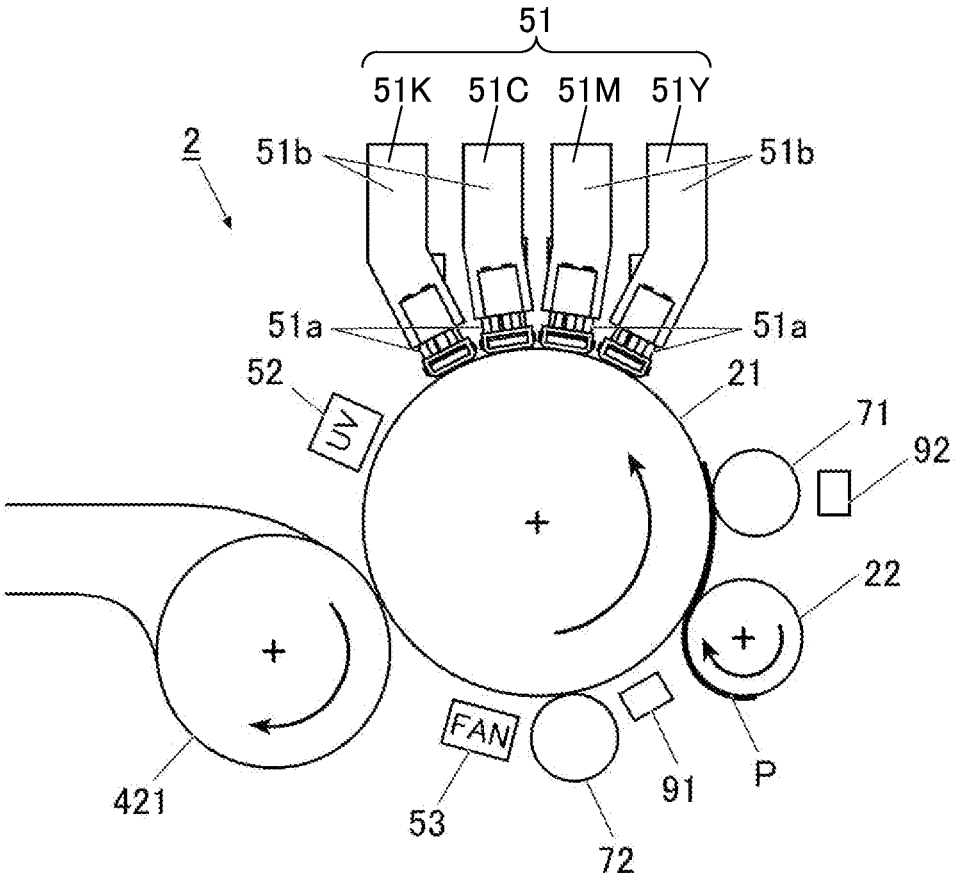
FIG. 2 is a diagram showing the internal configuration of an image forming section.

Next, the configuration of image forming section 2 will be described mainly with reference to FIG. 2. As shown in FIGS. 1 and 2, to form an image on recording medium P, image forming section 2 includes image forming drum 21 that holds this recording medium P on the surface and delivery drum 22 that delivers recording medium P conveyed from sheet feed section 3, to image forming drum 21.

Delivery drum 22, which holds recording medium P on its outer peripheral surface, includes a plurality of claws that clamps one end of recording medium P, and attracting sections (not shown) for attracting recording medium P onto the outer peripheral surface. The attracting section attracts recording medium P to the outer peripheral surface of delivery drum 22 by electrostatic attraction or suction. Delivery drum 22 has a part of the outer periphery close to image forming drum 21 so that recording medium P is delivered to image forming drum 21 at this close portion.

In one specific example, image forming section 2 uses ink that changes in phase from gel to liquid according to temperature, and the temperature of the ink is adjusted by heating recording medium P to control the smoothness and gloss of ink dots during formation of images. Accordingly, image forming drum 21 is assumed to be heated, and the outer peripheral surface of this image forming drum 21 has a multilayer structure in which a heat storage layer is formed on a heat insulating layer.

As shown in FIG. 2, a plurality of ink ejection sections 51, UV lamp 52, drum temperature sensor 91, heating rollers 71 and 72, and cooling fan 53 are disposed around image forming drum 21 in image forming section 2. Image forming drum 21, ink ejection section 51, and the like are accommodated in enclosure 20 (see FIG. 1) of image forming section 2.

In this embodiment, among sheet feed conveyor section 32 that conveys recording medium P, delivery drum 22, image forming drum 21, and collection conveyor section 42, delivery drum 22, image forming drum 21, and a part of collection conveyor section 42 accommodated in enclosure 20 correspond to a conveyor section that conveys recording medium P. The detailed configuration of enclosure 20 will be described later.

Ink ejection section 51 is configured so that inkjet heads (recording heads 510 which will be described later) that eject ink can be attached and detached to/from it, and includes head section 51*a* that ejects ink and carriage 51*b* that holds head section 51*a*.

In this example, a total of four ink ejection sections 51 (51K, 51C, 51M, and 51Y) are provided so that four colors of ink of black (K), yellow (Y), magenta (M), and cyan (C) can be ejected. In inkjet recording apparatus 1, the number of ink ejection sections 51 can be increased or decreased in accordance with the number of necessary colors (see FIG. 10 in which white (W) is added).

Head sections 51*a* in these ink ejection sections 51K, 51C, 51M, and 51Y are arranged along the circumferential direction of image forming drum 21 and along the conveyance direction of recording medium P as shown in FIG. 2. In this example, head sections 51*a* are line-type recording head sections that extend over the entire length of image forming drum 21 (the axial length of the drum (the same applies hereinafter)).

As shown in FIG. 2, for example, ultraviolet (UV) lamp 52 for radiating energy rays such as ultraviolet rays is disposed immediately downstream in the conveyance direction from recording medium P in the plurality of ink ejection sections 51. UV lamp 52 extends over the entire length of image forming drum 21 and irradiates recording medium P lying on image forming drum 21 with energy rays.

Collection conveyance chain sprocket 421 of the aforementioned collection conveyor section 42 is disposed immediately downstream in conveyance direction Y from UV lamp 52. A part of the outer periphery of collection conveyance chain sprocket 421 approaches image forming drum 21 via collection conveyance belt 424, and recording medium P is delivered from image forming drum 21 to collection conveyance belt 424 through this approaching part. Further, a cooling fan 53 that cools the outer peripheral surface of image forming drum 21 by blowing air is provided immediately downstream from collection conveyance chain sprocket 421. Heating roller 72 of the second heating section is provided immediately downstream from cooling fan 53, and drum temperature sensor 91 that measures the surface temperature of image forming drum 21 is also disposed immediately downstream therefrom.

Heating roller 71 as a heating body heats recording medium P that is held on image forming drum 21 and has yet to be subject to recording through ink ejection section 51, and is disposed immediately downstream in conveyance direction Y from delivery drum 22, that is, between delivery drum 22 and ink ejection section 51. Although not shown, heating roller 71 includes a hollow pipe made of a metal, such as aluminum, an elastic layer, such as silicon rubber, covering the entire circumference of the hollow pipe, and a heating source, such as a halogen heater, built in the hollow pipe for heating entire heating roller 71. The roller surface of heating roller 71 is in contact with the outer peripheral surface of image forming drum 21, and recording medium P is interposed between heating roller 71 and image forming drum 21 during formation of an image. At this time, heating roller 71 presses recording medium P against the outer peripheral surface of image forming drum 21 to bring it into close contact therewith.

In inkjet recording apparatus 1, heating section temperature sensor 92 that detects the temperature of heating roller 71 of the first heating section is also provided to heating roller 71. Further, around image forming drum 21, heating roller 72 having the same structure as above-described heating roller 71 is provided downstream from collection conveyance chain sprocket 421 and upstream from delivery drum 22 (specifically, between cooling fan 53 and drum temperature sensor 91).

Figure 3:
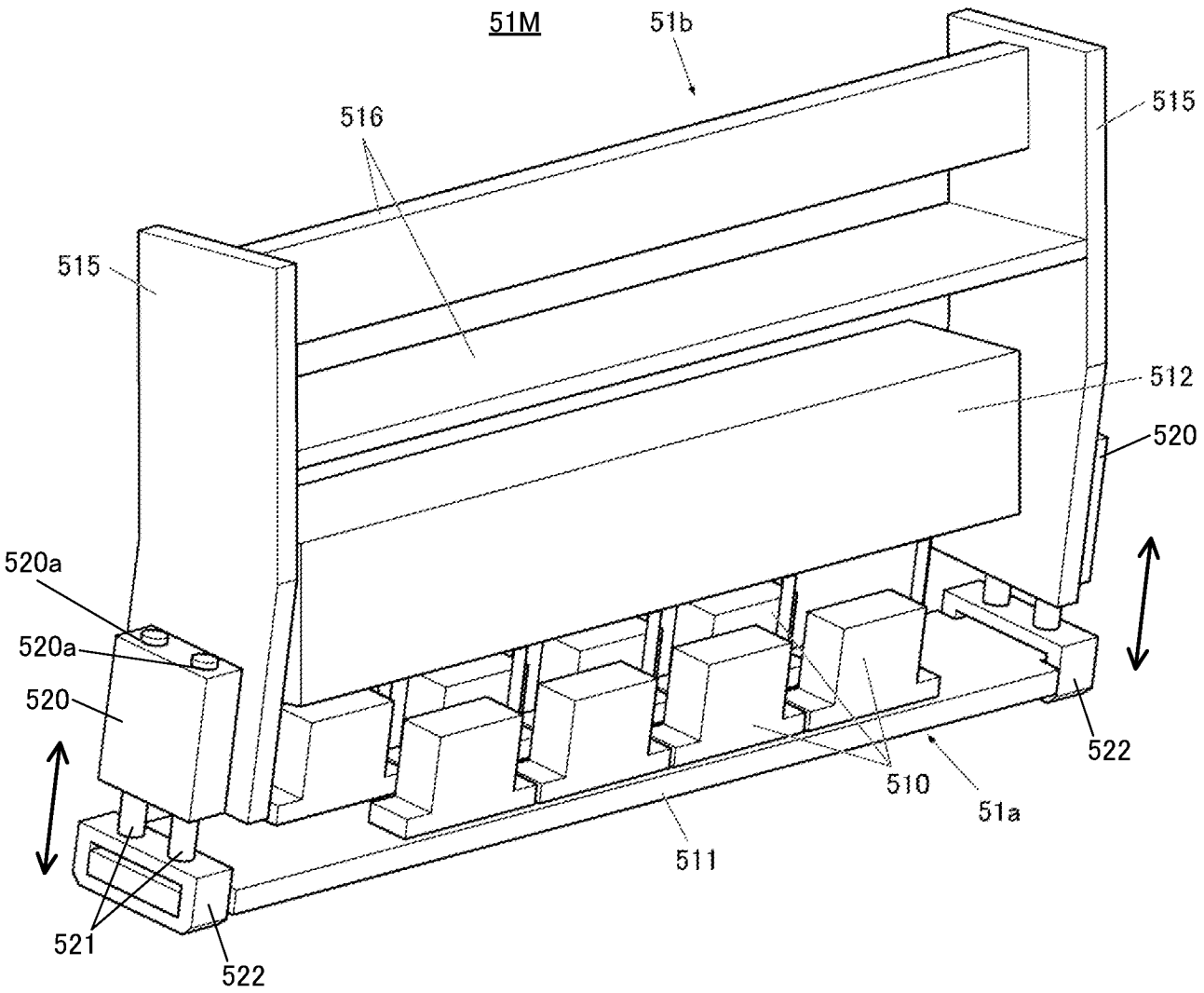
FIG. 3 is a perspective view showing a schematic configuration of an ink ejection section.
Figure 4:
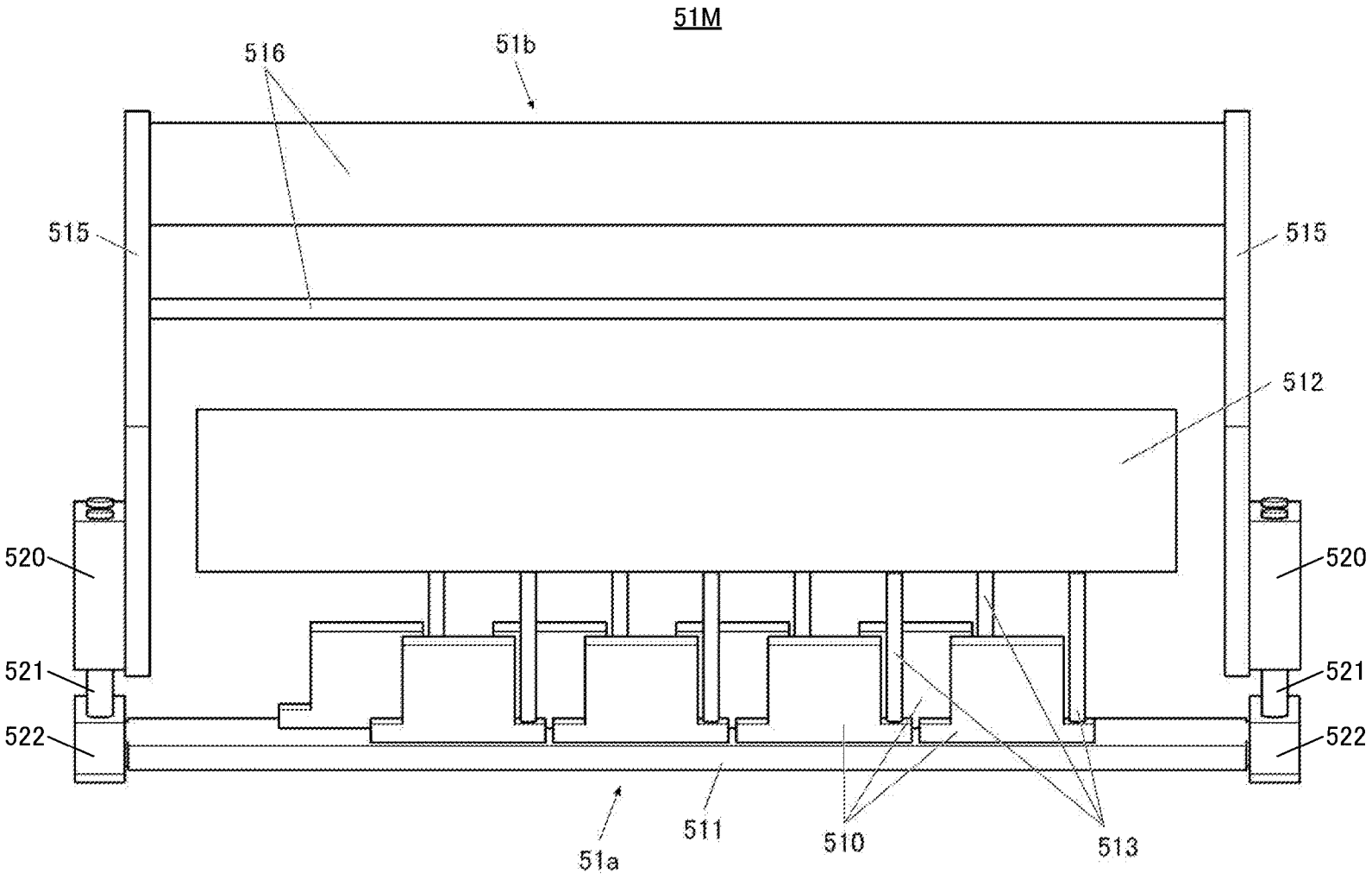
FIG. 4 is a front view showing a schematic configuration of the ink ejection section.
Figure 5:
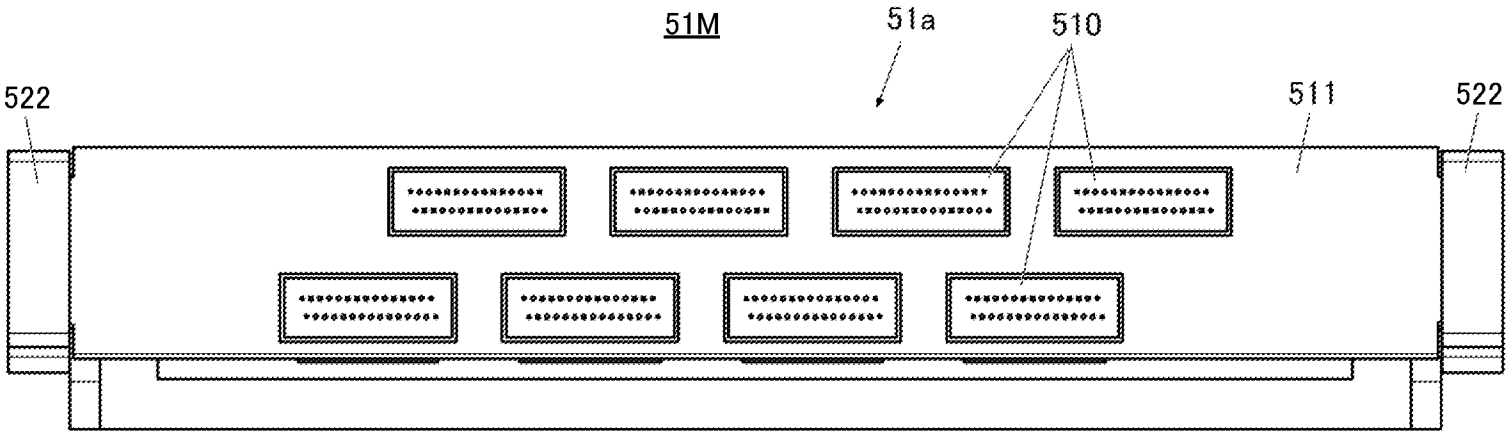
FIG. 5 is a bottom view showing a schematic configuration of the ink ejection section.

Next, the more specific configuration of ink ejection section 51 will be described with reference to FIGS. 3 to 5. The four ink ejection sections 51 (51K, 51C, 51M, and 51Y) described above have the same configuration except for the ink used and the parts specifically described. Therefore, the following describes ink ejection section 51M as a representative. FIG. 3 is a perspective view showing the configuration of ink ejection section 51M. FIG. 4 is a front view of ink ejection section 51M, and FIG. 5 is a bottom view of ink ejection section 51M. As shown in FIGS. 3 to 5, ink ejection section 51 (51M) includes head section 51*a* and carriage 51*b* that holds head section 51*a*.

Head section 51*a* includes a plurality of recording heads 510 that eject ink (corresponding to the "inkjet head" of the present invention), head fixing plate 511 on which the plurality of recording heads 510 are detachably disposed, and ink tank 512 that stores ink to be supplied to each recording head 510. FIG. 3 and other drawings show an exterior case (512) of the ink tank (container), and the exterior case is fixed to side plates 515. In addition, an electronic circuit (electric component) for supplying drive current to each recording head 510 is also provided in the exterior case of the ink tank. Head section 51*a* includes ink tube 513 that constitutes a flow path for supplying ink from ink tank 512 to each recording head 510. Of these, head fixing plate 511 of head section 51*a* corresponds to a "head fixing member" to which a plurality of (eight in this example) recording heads 510 are fixed and to/from which these recording heads 510 are attached and detached.

In this embodiment, a plurality of recording heads 510 are attached to head fixing plate 511 along the direction of the rotational axis of image forming drum 21 (see FIGS. 2 and 3). Further, in this embodiment, the plurality of recording heads 510 are arranged on head fixing plate 511 so as to form a plurality of rows along a direction that intersects the direction of conveyance of recording medium P by image forming drum 21 (in the illustrated example, a direction orthogonal to the conveyance direction). In this embodiment, as shown in FIGS. 3 and 4, recording heads 510 are fixed to head fixing plate 511 so that they are arranged in two rows each including four recording heads 510 and eight recording heads 510 are arranged in a staggered manner.

In this embodiment, head fixing plate 511 has a length equal to the entire length of image forming drum 21 described above. Planar rectangular eight opening sections (see FIG. 5) are formed in a zigzag pattern so that recording heads 510 are detachably fixed to head fixing plate 511, and the ink ejected from recording heads 510 can be ejected toward the outer peripheral surface of image forming drum 21. The recording heads 510 are attached to the opening sections in head fixing plate 511 so that its ink ejection surface is exposed on the lower surface of head fixing plate 511, and eject ink from the lower surface side of head fixing plate 511.

As shown in FIGS. 3 and 4, carriage 51*b* includes a pair of arm-like side plates 515 that hold head fixing plate 511 so as to clamp opposite ends of head fixing plate 511, and two coupling plates 516 that couple the pair of side plates 515.

Figure 15:
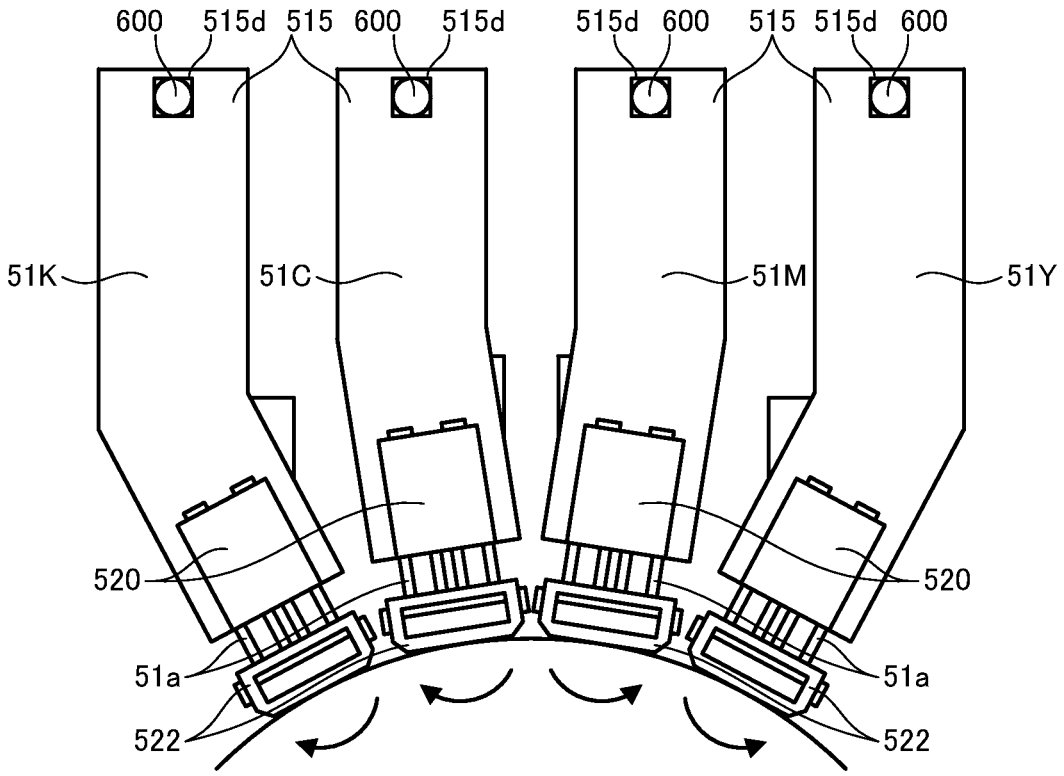
FIG. 15 is a diagram showing a third configuration example of the head angle adjusting mechanism (posture adjuster section) in this embodiment.

Although not shown, the upper portion of the side plates 515 in carriage 51*b* is connected to a rail that extends in a direction intersecting with (in this example, a direction orthogonal to) the direction of the conveyance of recording medium P (see FIG. 15 as appropriate). Carriages 51*b* of each of the four ink ejection sections 51K, 51C, 51M, and 51Y is configured to be individually movable along the corresponding rail in a direction intersecting with the direction of the conveyance of recording medium P. With this configuration, head section 51*a* mounted on each carriage 51*b* is individually movable. To be specific, ink ejection sections 51K, 51C, 51M, and 51Y can be moved to a print position (first position) where they face image forming drum 21 to form an image and to a maintenance position (second position) where they get away from image forming drum 21 toward a direction intersecting with the direction of the conveyance of recording medium P. This will be described later.

Moreover, carriage 51*b* is mainly provided with a height adjusting section for adjusting the distance or height of head fixing plate 511 with respect to image forming drum 21. The height adjusting section includes a pair of holder sections 520 fixed to the lower portion outside each side plate 515, a pair of bases 522 fixed to opposite ends in the length direction of head fixing plate 511, and a plurality of (two in this example) columnar base shafts 521 that extend upward and are provided on the base 522 (see FIG. 3).

Here, holder section 520 includes two holes 520*a* passing in the up-and-down direction and extending by a diameter corresponding to the diameter of base shaft 521, and base shaft 521 inserted into each hole 520*a* is fixed (held) by, for example, fastening such as screwing. With this configuration, as indicated by the double-headed arrows in FIG. 3, the distances between the two holder sections 520 and the side plates 515 and the corresponding bases 522 and head fixing plate 511 are adjusted so that the distance or height of head fixing plate 511 with respect to image forming drum 21 can be individually adjusted on the back side and the near side of the apparatus.

Figure 6:
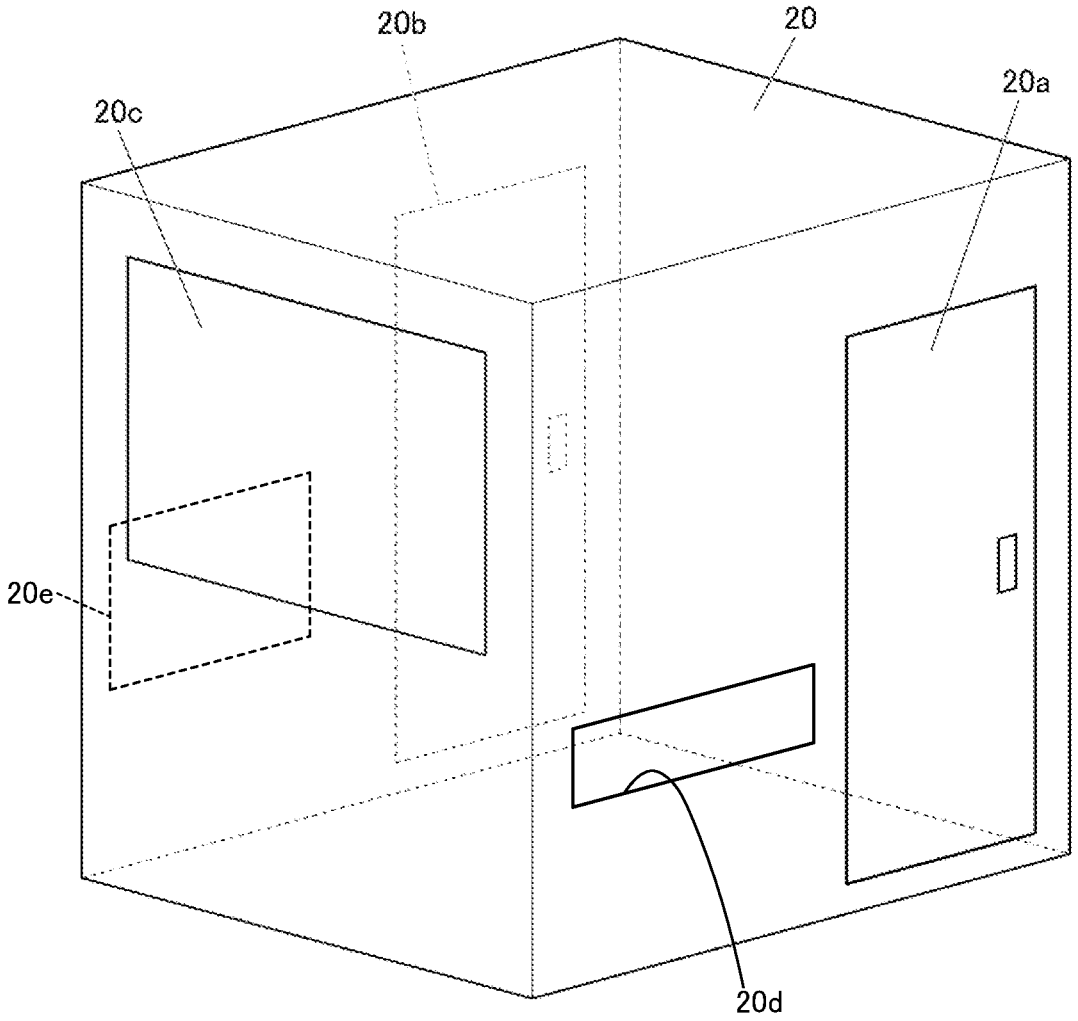
FIG. 6 is a perspective view showing a schematic configuration of an enclosure.
Figure 7:
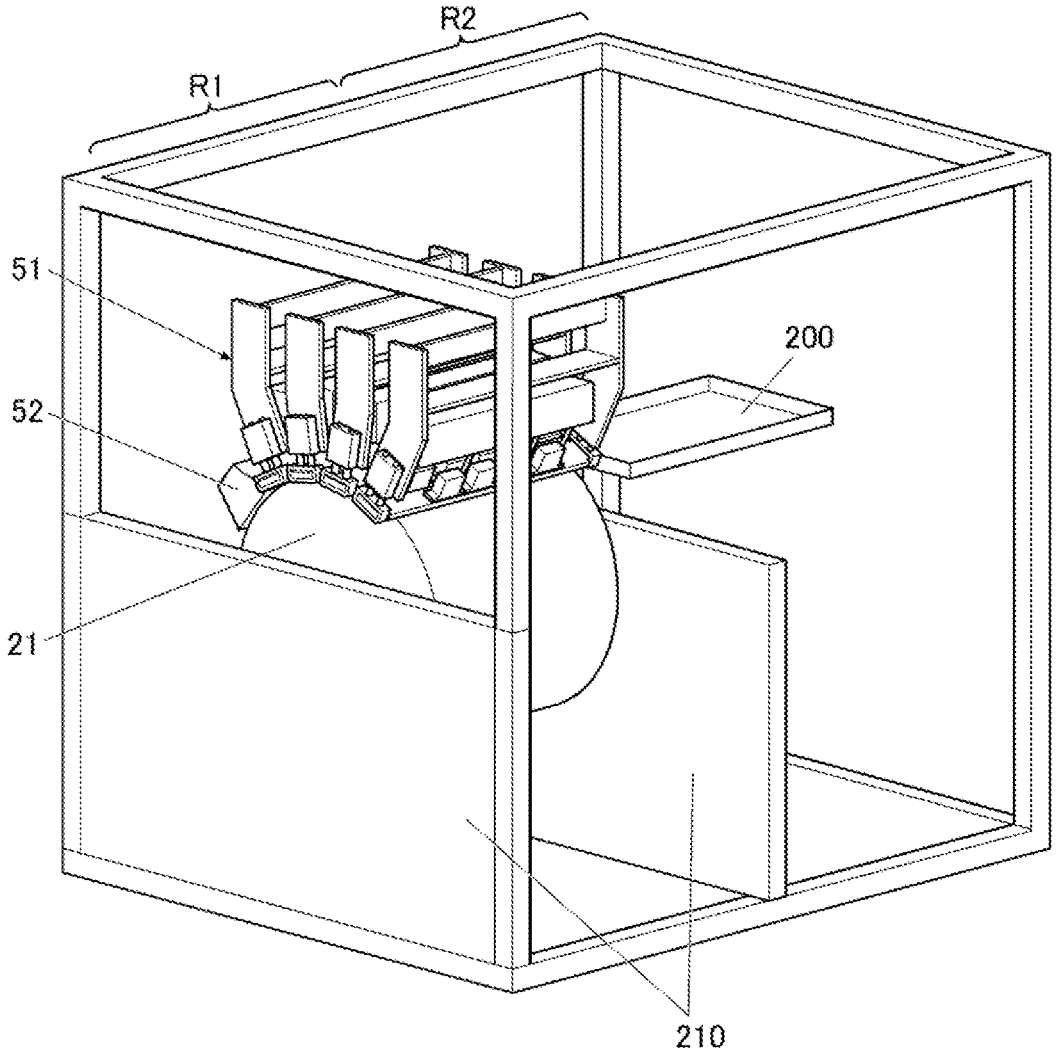
FIG. 7 is a diagram for explaining the positioning of an image forming drum and the ink ejection section inside the enclosure.
Figure 8:
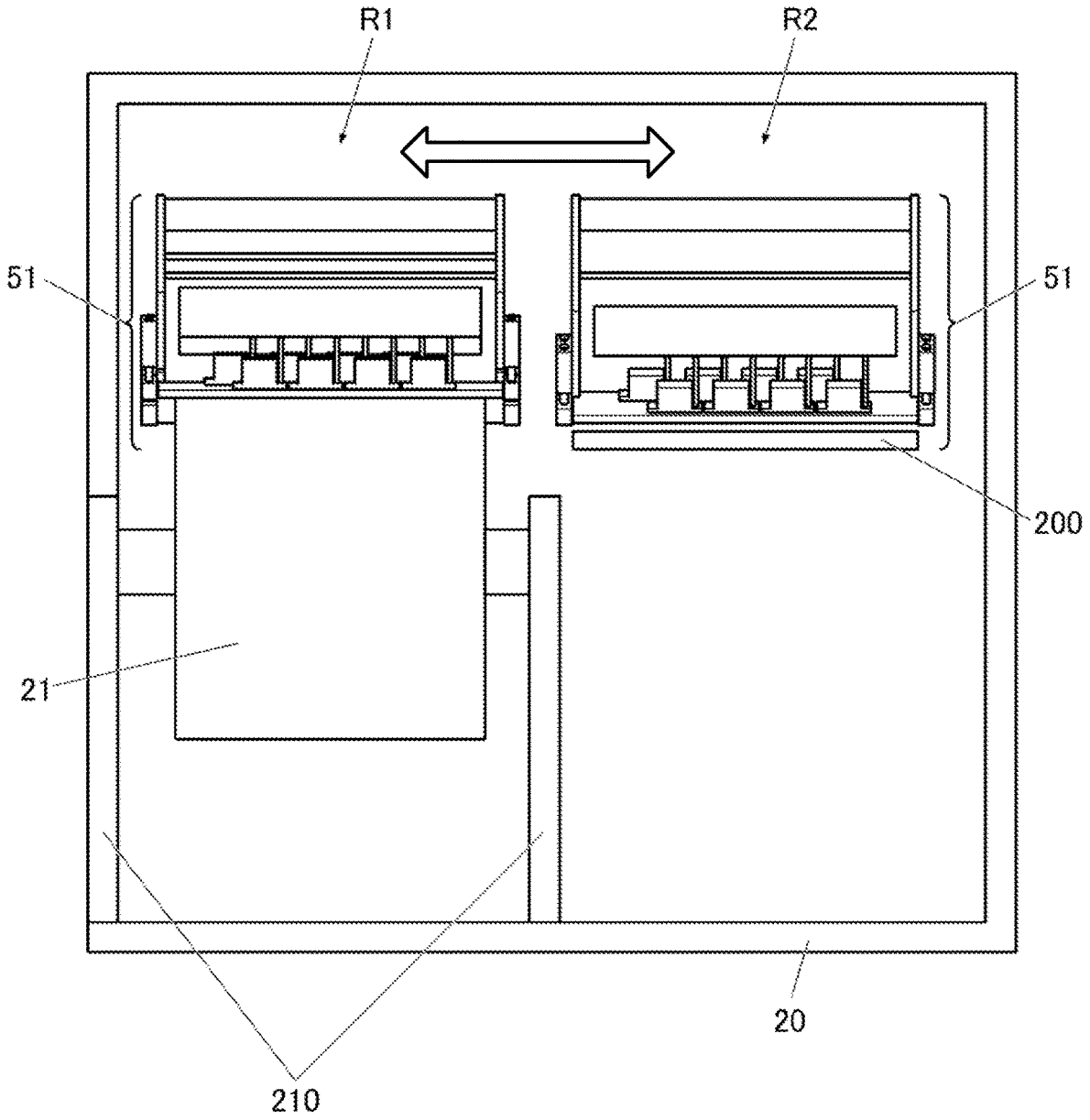
FIG. 8 is a diagram showing the print position and maintenance position inside the enclosure.

FIG. 6 is a perspective view showing a schematic configuration of enclosure 20 in image forming section 2. FIG. 7 is an explanatory diagram showing the positioning of image forming drum 21 and ink ejection section 51 inside enclosure 20. FIG. 8 is an explanatory diagram showing print position R1 and maintenance position R2 inside enclosure 20.

As shown in FIGS. 1 and 6, image forming section 2 includes enclosure 20 that accommodates the above-described image forming drum 21, the plurality of ink ejection sections 51 (head sections 51*a* and carriages 51*b*), and the like. Enclosure 20 covers the periphery of ink ejection section 51 in order to prevent the UV curable ink from being exposed to natural light until the UV curable ink is cured by UV lamp 52, particularly to accommodate head section 51*a* of ink ejection section 51 in the light shielding space.

Enclosure 20 has openable and closable doors 20*a* and 20*b* attached to the working openings (opening sections) in two wall surfaces extending in a direction substantially parallel to the rotation axis of image forming drum 21 so that an operator can enter and exit for the maintenance of, for example, a plurality of ink ejection sections 51 (head sections 51*a* and carriages 51*b*) in image forming section 2. Window section 20*c* is provided to a wall surface of enclosure 20 that extends in a direction orthogonal to the rotation axis of image forming drum 21.

An opening section 20*d* into which one end of the above-described sheet feed conveyance belt 323 (see FIG. 1) is inserted is formed in the wall surface provided with door 20*a*. An opening section 20*e* into which one end of the above-described collection conveyance belt 424 is inserted is formed in the wall surface provided with door 20*b*.

In enclosure 20, doors 20*a* and 20*b* are doors that are opened and closed when an operator enters and leaves enclosure 20 for maintenance. Window section 20*c* is a door that can be opened for checking the state of the inside of enclosure 20.

In enclosure 20, one door 20*a* is provided on the wall surface located upstream in the direction of the conveyance of recording medium P from the rotation axis of image forming drum 21. The other door 20*b* is provided on the wall surface located downstream in the direction of the conveyance of recording medium P from the rotation axis of image forming drum 21. Window section 20*c* is provided on the wall surface close to a side of image forming drum 21.

Enclosure 20 as a whole including doors 20*a* and 20*b* and window section 20*c* is preferably composed mainly of a metal material that does not transmit natural light. However, for window section 20*c*, an acrylic plate that has been subjected to UV cut processing may be used so that the state of the inside can be checked without opening window section 20*c*.

In this enclosure 20, image forming drum 21 is between a pair of highly rigid side plates 210 and is rotatably supported (see FIG. 7). In addition, maintenance tank 200 is provided on a side of image forming drum 21 and in a position out of the path of the conveyance of recording medium P, in enclosure 20. This maintenance tank 200 has a function of preventing the replacement parts from dropping during maintenance of ink ejection section 51, and functions as a tray (receiving section) for receiving ink dropped by pressure discharge for removing foreign matters and bubbles from recording head 510.

In this embodiment, a carriage moving section is provided for changing the position of each of the plurality of ink ejection sections 51 (51K, 51C, 51M, and 51Y) to print position R1 or maintenance position R2. The carriage moving section includes a drive source, such as a motor or a solenoid (not shown), for each of the ink ejection sections 51K, 51C, 51M, and 51Y. The drive force of the drive source is transmitted to carriage 51*b* (for example, side plate 515) of the corresponding ink ejection section 51K, 51C, 51M, or 51Y, so that this carriage 51*b* is moved along the rail described above (see the double-headed arrow in FIG. 8) to print position R1 or maintenance position R2.

In this embodiment, as shown in FIG. 7, the aforementioned operation of the carriage moving section locates all the ink ejection sections 51 (51K, 51C, 51M, and 51Y) to print position R1 (first position) facing image forming drum 21, during formation of an image. In contrast, during maintenance, the plurality of ink ejection sections 51 are individually moved to maintenance position R2 (second position) located in the direction away from image forming drum 21 and above maintenance tank 200 (see FIG. 8).

Figure 9:
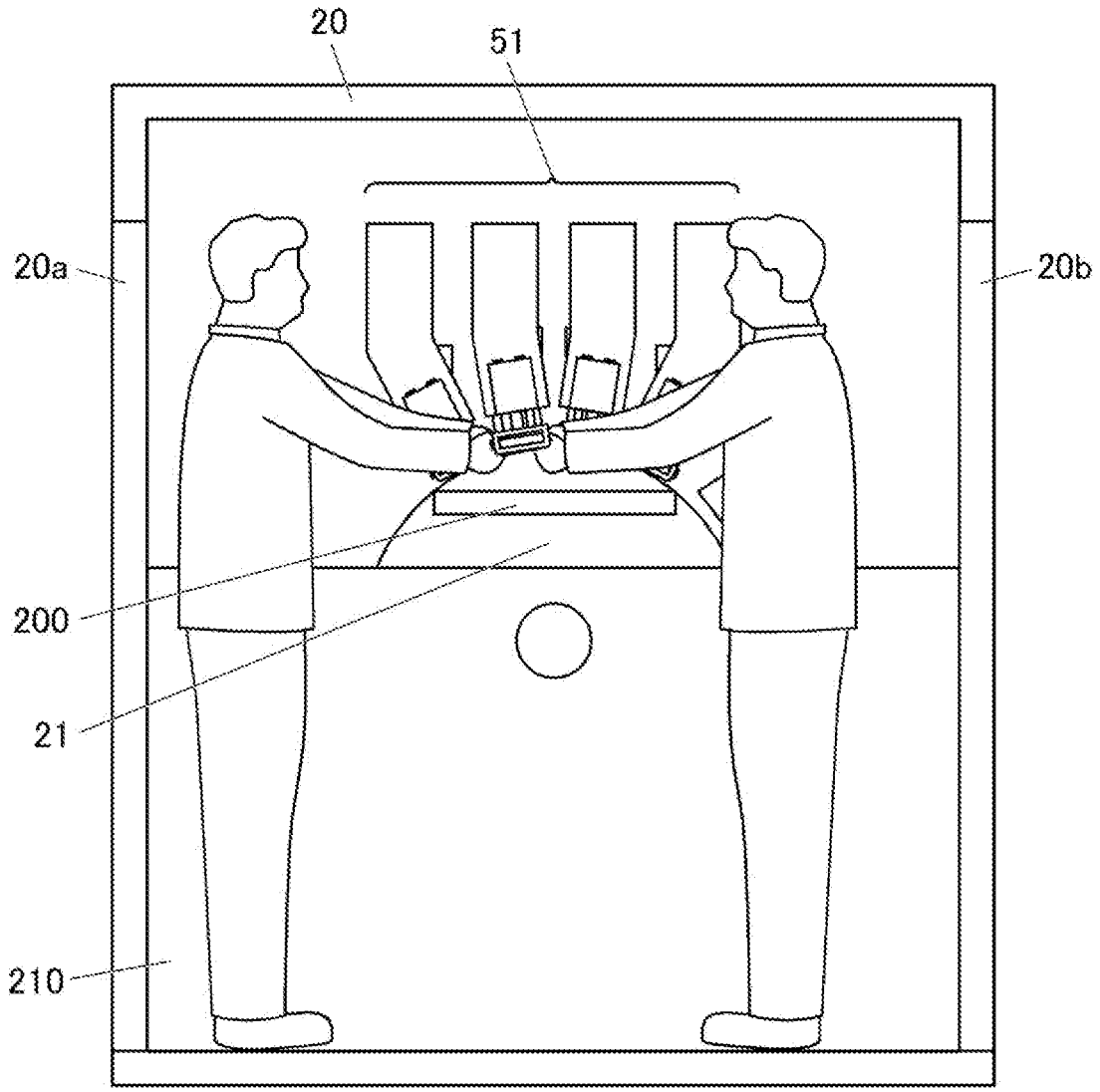
FIG. 9 is an explanatory diagram related to the standing position of an operator who performs maintenance work inside the enclosure.

During this maintenance, operators enter enclosure 20 from door 20*a* and door 20*b*, respectively, so that as shown in FIG. 9, the operators can enter two positions across ink ejection section 51 that has been moved to maintenance position R2 and perform maintenance work from both sides of ink ejection section 51.

As described above, in inkjet recording apparatus 1, arbitrary ink ejection sections 51 (that is, head section 51*a* and carriage 51*b*) of the plurality of ink ejection sections 51 can individually be moved to maintenance position R2 in a direction away from image forming drum 21. In inkjet recording apparatus 1, the operators enter enclosure 20 from doors 20*a* and 20*b*, respectively, and can therefore approach from both sides of carriage 51*b* that has been moved to maintenance position R2. Further, in inkjet recording apparatus 1, one carriage 51*b* that has been moved to maintenance position R2 is faced by two operators from both sides so that various types of maintenance work can be performed.

However, with the above-described configuration, the problem arises that workability for attaching and detaching recording head 510 to/from head fixing plate 511 for changing recording head 510 by moving ink ejection section 51 (carriage 51*b* and the like) to maintenance position R2 is poor.

To be specific, as described above, carriage 51*b* moves to maintenance position R2 along each connected rail. Here, with the conventional configuration, the postures of carriage 51*b* and head section 51*a* that have been moved to maintenance position R2 (the angles to image forming drum 21) are the same as before the movement.

Figure 10:
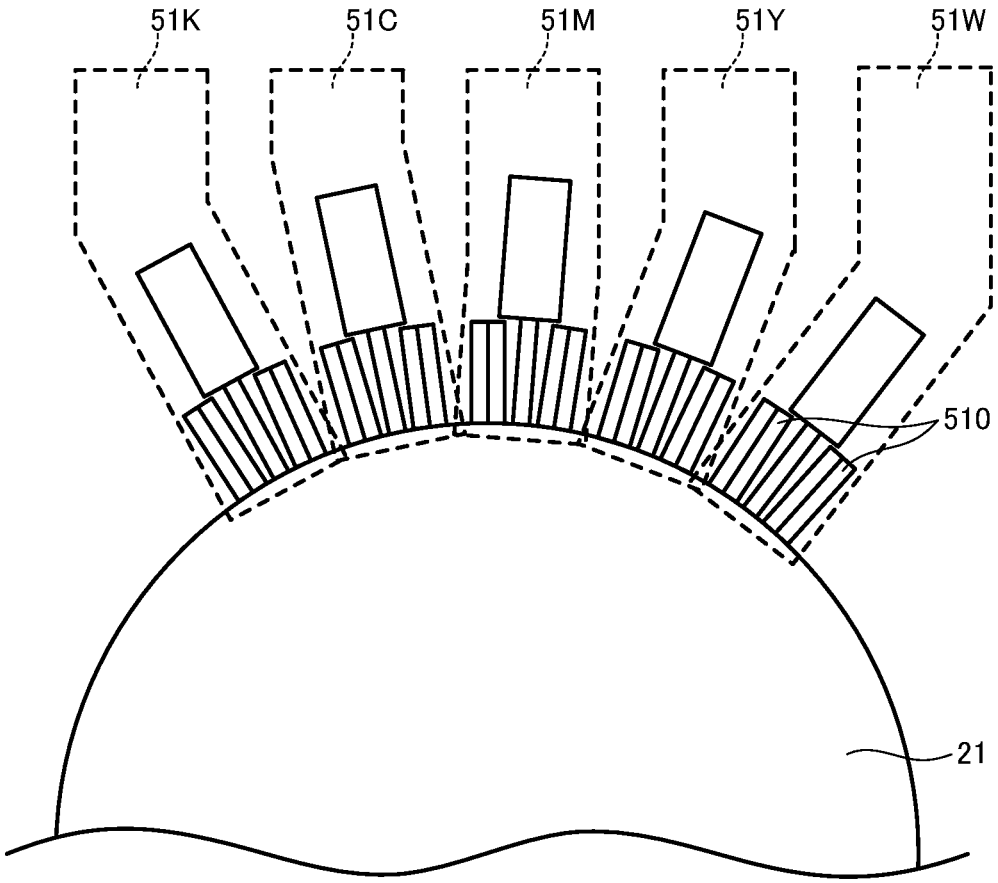
FIG. 10 is a diagram for explaining problems in performing maintenance work inside the enclosure.

More specifically, as schematically shown in FIG. 10, the basic posture of ink ejection section 51 in image forming position R1 is such a posture that the ink ejected from recording head 510 is oriented at an angle toward the rotation axis (rotation center) of image forming drum 21. For this reason, side plates 515 of carriage 51*b* are bent so that the bottom surface of head fixing plate 511 in the corresponding head section 51*a* is parallel to the circumscribing line of the peripheral surface of image forming drum 21 (see FIG. 2, for example). Even when carriage 51*b* moves along the rail from image forming position R1 to maintenance position R2, the aforementioned basic posture is maintained because aforementioned side plates 515 are connected to the rail.

For this reason, with the conventional configuration, maintenance work should be performed in a state where head fixing plate 511 and recording head 510 are slightly inclined with respect to the floor surface of enclosure 20 and maintenance tank 200, and how they are inclined or their inclination angles differ between ink ejection sections 51. When the operator attaches and detaches recording head 510 with such inclination, depending on the location of recording head 510 on head fixing plate 511, ink tank 512 and coupling plate 516 above recording head 510 may become an obstacle, which makes it difficult for the operator's hand to reach that recording head 510 (see FIG. 10 and other drawings as appropriate) and deteriorates the attachment/detachment workability.

Accordingly, in this embodiment, a posture adjusting section is provided for adjusting the posture of ink ejection section 51 and thus head fixing plate 511 moved to maintenance position R2. In this embodiment, the posture adjusting section changes the angle of the entire ink ejection section 51 or changes the angle of head fixing plate 511, thereby changing the angle of each recording head 510 mounted on head fixing plate 511 with respect to image forming drum 21 from the basic posture described above. This posture adjusting section will hereinafter be referred to as a "head angle adjusting section".

In this embodiment, the head angle adjusting section allows adjustment of the angle (orientation) of at least head fixing plate 511 to which recording head 510 is attached in carriage 51*b*, thereby changing the angle of a plurality (eight in this example) of recording heads 510 at once. More specifically, the head angle adjusting section has a mechanism for changing the angle (orientation) of the bottom surface of head fixing plate 511 to the horizontal direction, thereby changing the attaching/detaching orientations of eight recording heads 510 with respect to head fixing plate 511 to the vertical direction.

A specific configuration example of the head angle adjusting section will be described below mainly using ink ejection section 51M as a representative.

First Configuration Example

Figure 11:
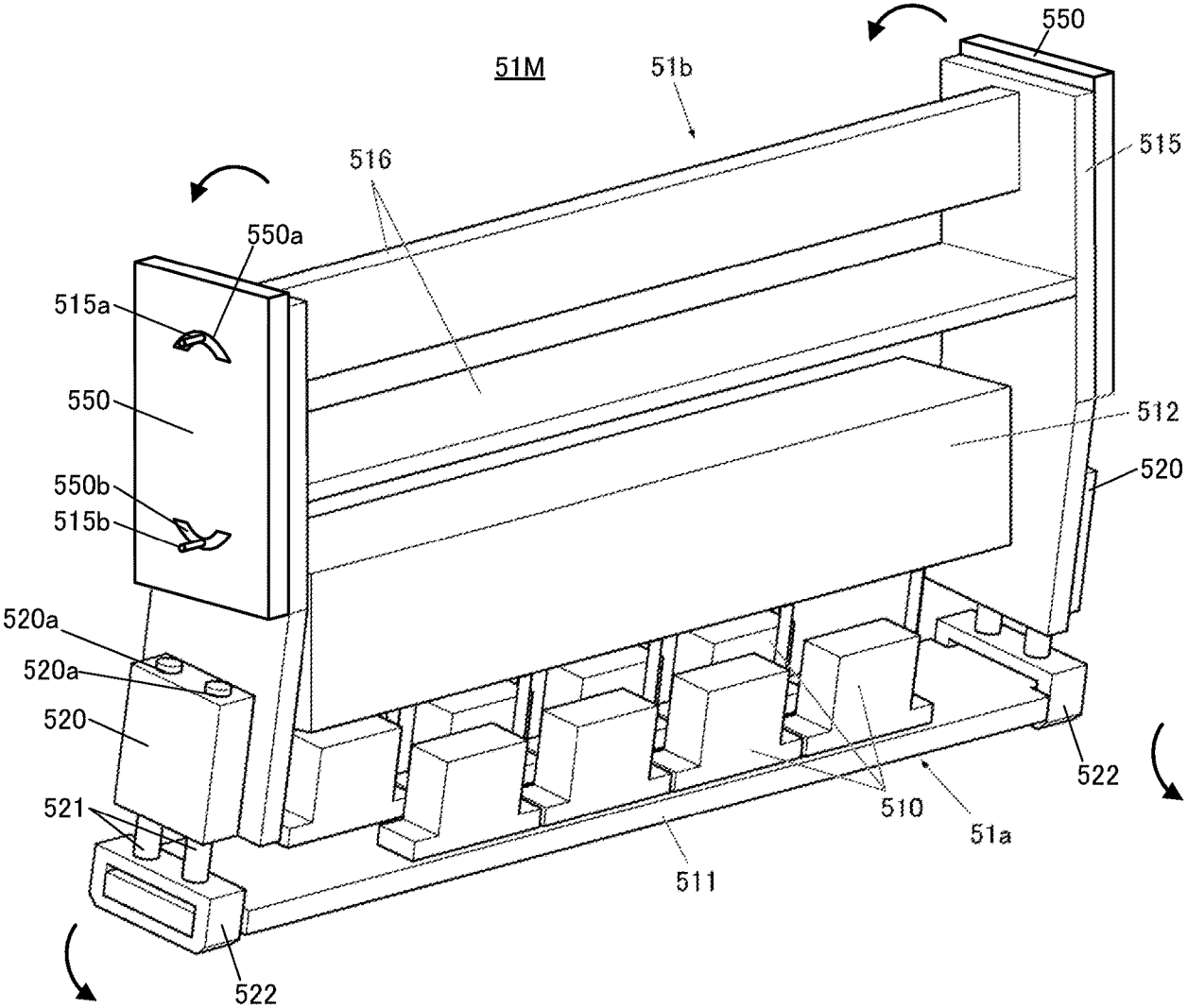
FIG. 11 is a diagram showing a first configuration example of a head angle adjusting mechanism (posture adjuster section) in this embodiment.

FIG. 11 shows a first configuration example of the head angle adjusting section. The head angle adjusting section of the first configuration example has a mechanism for changing the angle of carriage 51*b* and thus the entire ink ejection section 51 in the state where carriage 51*b* has been moved to maintenance position R2.

More specifically, the head angle adjusting section of the first configuration example includes a pair of guide plates 550 that are assembled so as to be movable (in this example, rotatable) relatively to the side surfaces of a pair of side plates 515 of carriage 51*b*. In this example, upper parts of guide plates 550 are connected to the aforementioned rail, and reciprocate between print position R1 and maintenance position R2 along the rail. For this reason, the posture of guide plates 550 (the angle to image forming drum 21) is the same before and after the movement, that is, in print position R1 and maintenance position R2.

In the first configuration example, side plates 515 (side plates) of carriage 51*b* are not connected to the rail. In the head angle adjusting section of the first configuration example, in order to adjust the posture (angle) of side plate 515 with respect to guide plate 550, a long hole and a shaft are provided in both of these members. In the example shown in FIG. 11, two shafts 515*a* and 515*b* are provided on side plates 515, and long holes 550*a* and 550*b* into which the shafts 515*a* and 515*b* are inserted are formed in guide plates 550.

In the first configuration example, the head angle adjusting section is composed of guide plates 550 having long holes 550*a* and 550*b* described above and shafts 515*a* and 515*b* provided to side plates 515.

In one example, during maintenance work, the operator moves any one of carriages 51*b* of the plurality of ink ejection sections 51K, 51C, 51M, and 51Y from print position R1 to maintenance position R2 together with guide plates 550, while maintaining the posture shown in FIG. 11. The operator then moves (for example, rotates) side plates 515 of carriage 51*b* so that the posture with respect to guide plates 550 having a fixed posture is changed in the state where it has been moved to maintenance position R2. At this time, shafts 515*a* and 515*b* of side plates 515 move while their movements are restricted by long holes 550*a* and 550*b* in guide plates 550.

Figure 12:
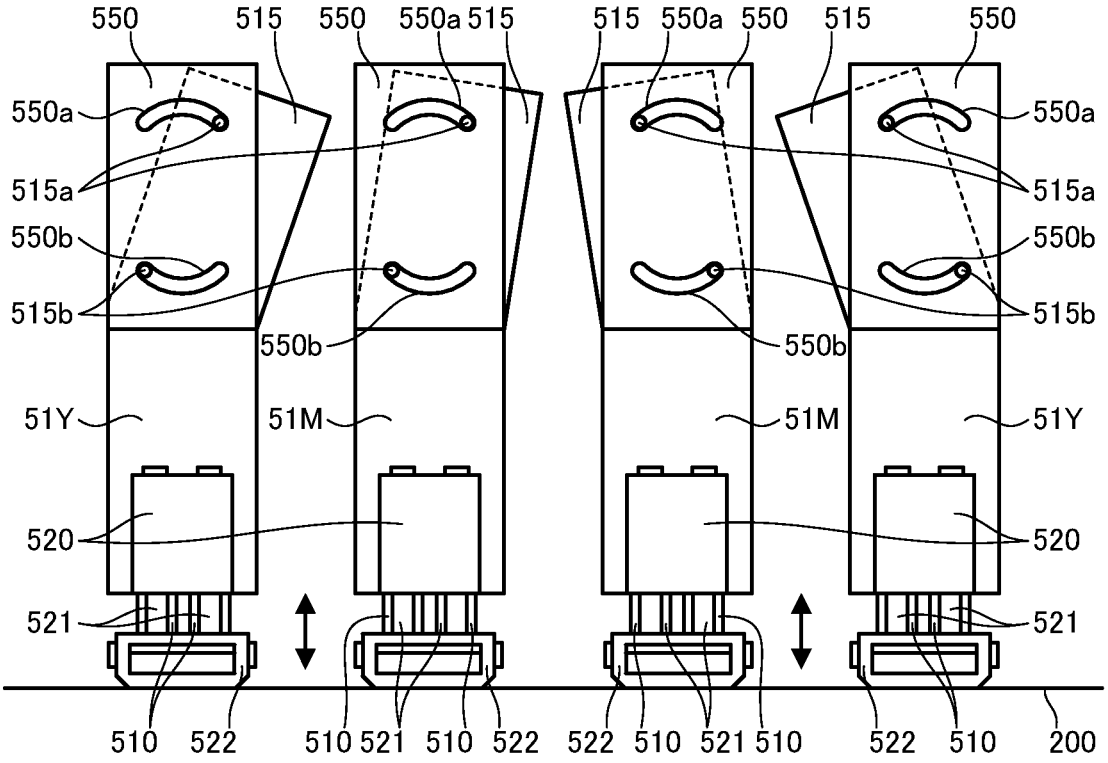
FIG. 12 is a side view showing a state after angle adjustment in the first configuration example.

In the first configuration example, as shown in FIG. 12, such an operation makes the angle (orientation) of the bottom surface of head fixing plate 511 horizontal, and appropriate operation of the above-described height adjustment section can bring the bottom surface of head fixing plate 511 into contact with maintenance tank 200. Thus, with the head angle adjusting section of the first configuration example, the posture of carriage 51*b* and thus head fixing plate 511 with respect to guide plates 550 is changed so that the angle (orientation) of the bottom surface of head fixing plate 511 is horizontal; thus, the orientations of attaching/detaching eight recording heads 510 to head fixing plate 511 can be changed to the vertical direction.

As shown in FIG. 12, in this embodiment, provided is a mechanism similar to the mechanism of the angle adjusting section described with reference to FIG. 11 for each of the carriages 51*b* of the plurality of ink ejection sections 51K, 51C, 51M, and 51Y. Therefore, in any of the plurality of ink ejection sections 51K, 51C, 51M, and 51Y, the attachment/detachment direction of each recording head 510 with respect to head fixing plate 511 can be changed to a fixed direction (vertical direction in this embodiment), which can improve the workability when recording head 510 is attached and detached by the operator.

In the example shown in FIGS. 11 and 12, long holes 550*a* and 550*b* have an arc shape, and the pair of side plates 515 of carriage 51*b* rotates along the arcs of long holes 550*a* and 550*b* with respect to the pair of guide plates 550. On the other hand, the shape of long holes 550*a* and 550*b* is not limited to this, and may be any shape that can adjust the angle (orientation) of the bottom surface of head fixing plate 511 to horizontal one.

Second Configuration Example

Figure 13:
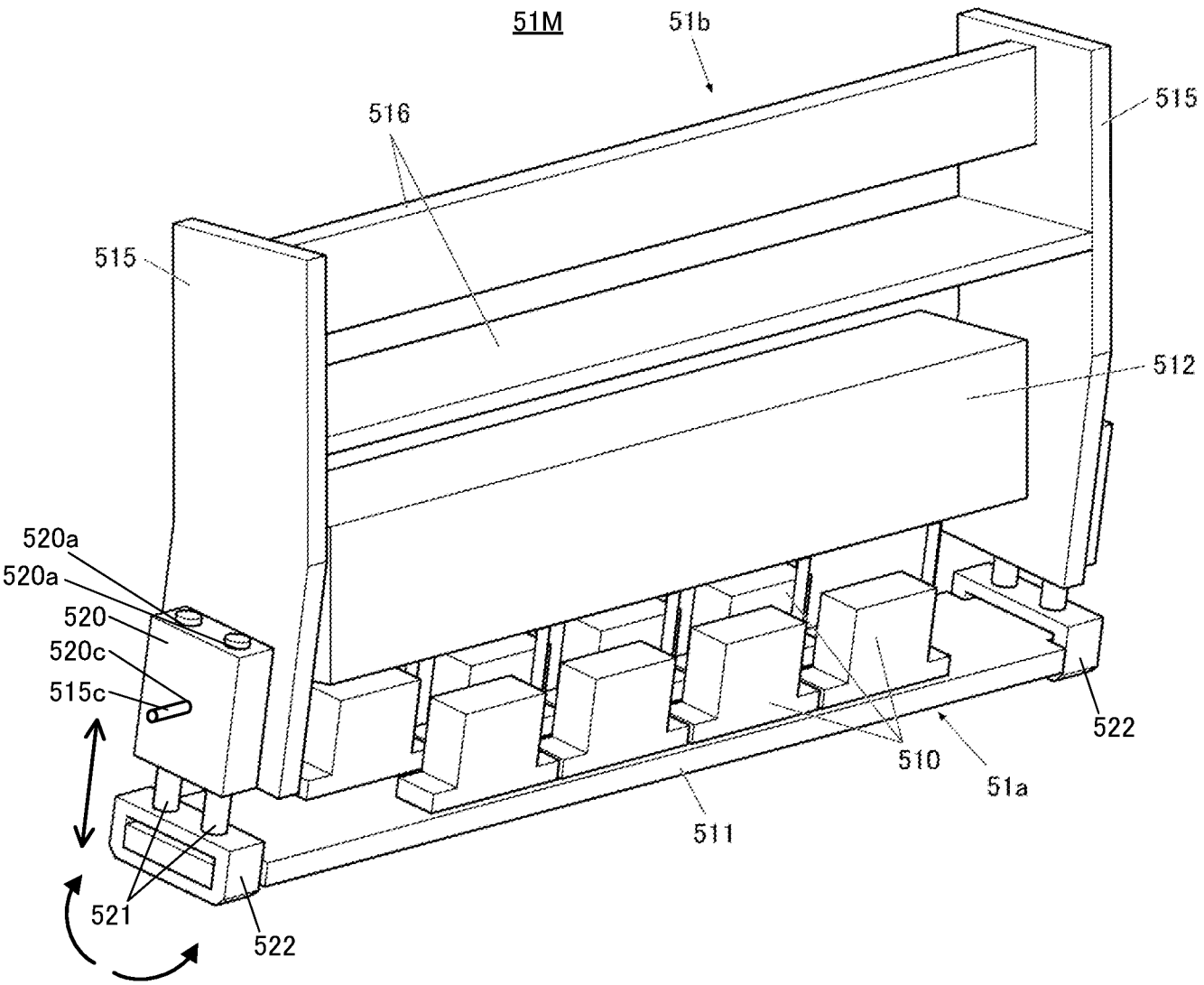
FIG. 13 is a diagram showing a second configuration example of the head angle adjusting mechanism (posture adjuster section) in this embodiment.

FIG. 13 shows a second configuration example of head angle adjusting section. The head angle adjusting section of the second configuration example has a mechanism that allows the angle of head fixing plate 511 to which eight recording heads 510 are attached to be changed with respect to other members (for example, ink tank 512, side plate 515, and coupling plate 516) above, in the state where carriage 51*b* has been moved to maintenance position R2.

In the second configuration example, side plates 515 are connected to the aforementioned rail as in the description above, and are movable between print position R1 and maintenance position R2 along the rail. Further, the postures of members such as side plates 515, coupling plates 516 fixed to side plates 515, and ink tank 512 (angles to image forming drum 21) are the same before and after the movement, that is, in print position R1 and maintenance position R2.

On the other hand, in the second configuration example, as shown in FIG. 13, aforementioned holder section 520, which is a component of the height adjusting section disposed outside side plates 515, is supported rotatably on side plates 515. In this example, cylindrical shaft 515*c* is provided at a portion below the side surface of side plate 515 facing holder section 520, and support hole 520*a* that rotatably supports this shaft 515*c* is formed in holder section 520. In FIG. 13, the same applies to the configurations of holder section 520 and side plate 515 on the right side.

In the second configuration example, the head angle adjusting section is composed of holder sections 520 provided with aforementioned support holes 520*a* and shaft 515*c* provided to side plates 515.

In one example, during the maintenance work, the operator moves any one of carriages 51*b* of the plurality of ink ejection sections 51K, 51C, 51M, and 51Y from print position R1 to maintenance position R2 while maintaining the posture shown in FIG. 13. The operator then holds head fixing plate 511 in the state where carriage 51*b* has been moved to maintenance position R2, and moves (rotates) head fixing plate 511 so as to change its posture (angle) with respect to side plate 515 and the like having a fixed posture. At this time, holder section 520 rotates about shaft 515*c* on side plate 515.

Figure 14:
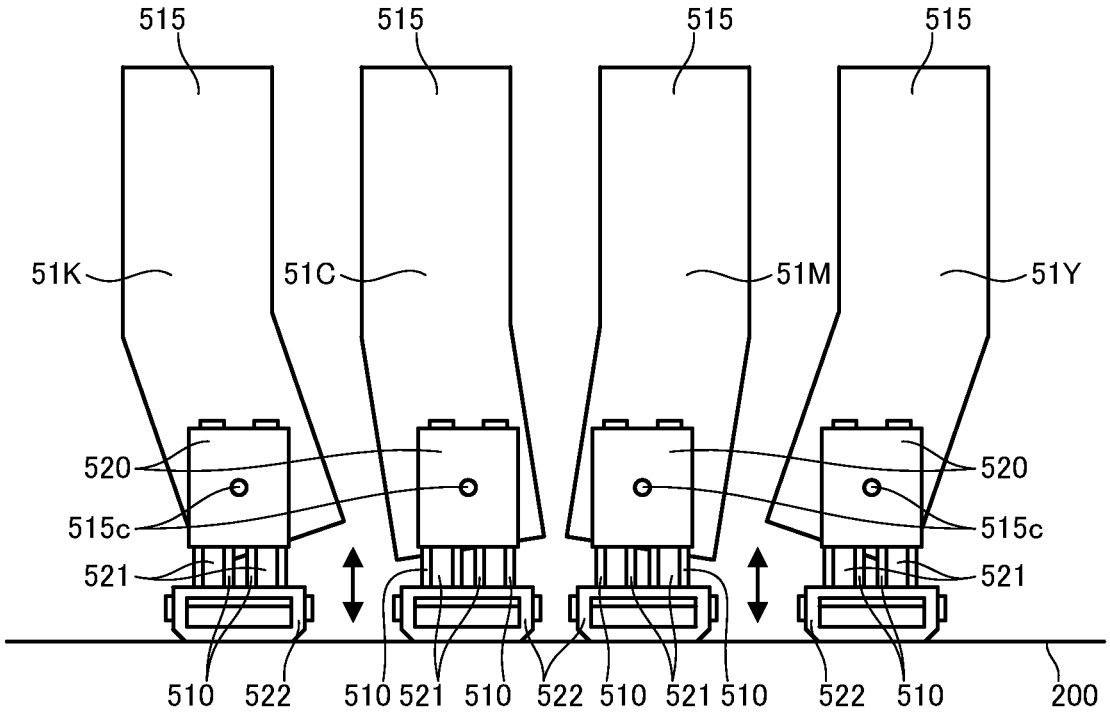
FIG. 14 is a side view showing a state after angle adjustment in the second configuration example.

In the second configuration example, as shown in FIG. 14, the angle (orientation) of the bottom surface of head fixing plate 511 is made horizontal by the aforementioned operation, and the bottom surface of head fixing plate 511 can be brought into contact with maintenance tank 200 by appropriately operating the aforementioned height adjusting section. Thus, with the head angle adjusting section of the second configuration example, the attachment/detachment orientations of eight recording heads 510 with respect to head fixing plate 511 can be changed to the vertical direction by changing the posture of holder section 520 relative to side plate 515 so that the angle (orientation) of the bottom surface of head fixing plate 511 is horizontal.

Further, in this embodiment, as shown in FIG. 14, a mechanism similar to the mechanism of the head angle adjusting section described with reference to FIG. 13 is provided for each of the carriages 51*b* of the plurality of ink ejection sections 51K, 51C, 51M, and 51Y. Therefore, in any of the plurality of ink ejection sections 51K, 51C, 51M, and 51Y, the attachment/detachment direction of each recording head 510 with respect to head fixing plate 511 can be changed to a fixed direction (vertical direction in this embodiment), which can improve the workability when recording head 510 is attached and detached by the operator.

Third Configuration Example

FIG. 15 shows a third configuration example of head angle adjusting section. The head angle adjusting section of the third configuration example has a mechanism for changing the angle of carriage 51*b* and thus the entire ink ejection section 51 in the state where carriage 51*b* has been moved to maintenance position R2, and is the same as the first configuration example in this respect.

On the other hand, in the head angle adjusting section of the third configuration example, the aforementioned guide plates 550 are not used and the attachment angle of carriage 51*b* and thus the angle of the entire ink ejection section 51 with respect to rail 600 can be moved when side plates 515 moving along rail 600 are moved to maintenance position R2.

In one specific example, the cross-sectional shape of rail 600 is a rectangle in the area where carriage 51*b* is in image forming position R1, and a circle inscribed in the rectangle (see FIG. 15) in the area where carriage 51*b* moves to maintenance position R2. Here, FIG. 15 shows a cross-sectional shape of rail 600 in an area where carriage 51*b* moves to maintenance position R2.

Meanwhile, rectangular hole 515*d* corresponding to the aforementioned rectangular cross-sectional shape of rail 600 is formed in an upper portion of each side plate 515.

In the third configuration example, the head angle adjusting section is composed of aforementioned rail 600 and side plates 515 each having hole 515*d* into which rail 600 is inserted.

In the third configuration example, during the maintenance work, the operator moves any one of carriages 51*b* of the plurality of ink ejection sections 51K, 51C, 51M, and 51Y (for example, ink ejection section 51Y) from print position R1 to maintenance position R2 while maintaining the posture shown in FIG. 15. The operator then holds head fixing plate 511, side plates 515, or the like in the state where carriage 51*b* has been moved to maintenance position R2, and moves (rotates) head fixing plate 511 so as to change its posture (angle) with respect to entire ink ejection section 51 (51Y). At this time, side plates 515 of carriage 51*b* rotate about rail 600 inserted therethrough (see the arrows in FIG. 15).

In the third configuration example, as in the case of first configuration example, the angle (orientation) of the bottom surface of head fixing plate 511 is made horizontal by the aforementioned operation, and the bottom surface of head fixing plate 511 can be brought into contact with maintenance tank 200 by appropriately operating the aforementioned height adjusting section (which is omitted in the drawings). Thus, with the head angle adjusting section of the third configuration example, the attachment/detachment orientations of eight recording heads 510 with respect to head fixing plate 511 can be changed to the vertical direction by changing the posture (rotational position) of side plates 515 with respect to rail 600 so that the angle (orientation) of the bottom surface of head fixing plate 511 is horizontal.

Further, in the third configuration example, as shown in FIG. 15, the head angle adjusting section having the same mechanism is provided for each of the carriages 51*b* of the plurality of ink ejection sections 51K, 51C, 51M, and 51Y. Therefore, in any of the plurality of ink ejection sections 51K, 51C, 51M, and 51Y, the attachment/detachment direction of each recording head 510 with respect to head fixing plate 511 can be changed to a fixed direction (vertical direction in this embodiment), which can improve the workability when recording head 510 is attached and detached by the operator.

As described above, inkjet recording apparatus 1 of this embodiment includes a head angle adjusting section (posture adjusting section) having a mechanism for changing the angle (orientation) of head fixing plate 511 from a direction toward the axis (rotation center) of image forming drum 21 in the state where ink ejection section 51 has been moved to maintenance position R2; therefore, the workability can be improved when recording head 510 is attached and detached to/from head fixing plate 511.

Depending on the configuration of the head angle adjusting section, for example, when the head angle adjusting section of the second configuration example described with reference to FIG. 13 and other drawings is employed, head fixing plate 511 may move (rotate) relatively to ink tank 512 fixed to side plates 515. In this case, a load may be applied to ink tube 513 (see FIG. 4) that supplies ink from ink tank 512 to each recording head 510.

Here, ink tube 513, which is generally composed of a flexible member, may absorb a slight load. However, when the load is absorbed by ink tube 513, the ink flow path length from ink tank 512 to recording head 510 may change (become longer). In this case, the print quality may degrade.

Accordingly, when a load may be generated on ink tube 513 due to a change in the posture of head fixing plate 511 or the like, if ink ejection section 51 is in image forming position R1 (first position), it is preferable to set the length of ink tube 513 so as to provide a droop, that is, give a margin to the length of the ink tube in advance. With this configuration, when ink ejection section 51 is moved to maintenance position R2 (second position) and the head angle adjusting section is operated, a load on the ink tube is avoided and the flow path length can be maintained Thus, the print quality can be maintained.

Further, in the first configuration example and the second configuration example, in order to prevent the posture of head fixing plate 511 and the like from changing during formation of an image, it is preferable that the head angle adjusting section (posture adjusting section) is operated after each of ink ejection sections 51 is moved to maintenance position R2(second position). In other words, it is desirable that the head angle adjusting section cannot not be operated while each of the ink ejection sections 51 is in image forming position R1 (first position).

In a specific example of such a configuration, a known lock mechanism (not shown) is provided to the shaft (the aforementioned shafts 515*a*, 515*b*, and 515*c*) in the head angle adjusting section, and upon movement to the second position, the lock on the shaft may be released.

Although embodiments of the present invention have been described and illustrated in detail, the disclosed embodiments are made for purpose of illustration and example only and not limitation. The scope of the present invention should be interpreted by terms of the appended claims.

What is claimed is:

1. A posture adjusting apparatus, comprising:

an ink ejector that has a detachable inkjet head that ejects ink; and a posture adjuster for adjusting a posture of the ink ejector, wherein the ink ejector includes a head fixing member to/from which the inkjet head is attached and detached, the ink ejector being movable between a first position where an image is formed on a recording medium by the inkjet head and a second position where the inkjet head is attached and detached, and the posture adjuster allows adjustment of an angle of the head fixing member with respect to a rail that extends in a direction intersecting a direction of conveyance of the recording medium, when the ink ejector is in the second position and the angle of the head fixing member with respect to the rail in the second position is different from the angle when the ink ejector is in the first position.

2. The posture adjusting apparatus according to claim 1, wherein the ink ejector includes a carriage that is coupled to the head fixing member and moves between the first position and the second position along the rail, and the posture adjuster adjusts the angle of the head fixing member by changing a posture of the carriage relative to the rail.

3. The posture adjusting apparatus according to claim 2, wherein the posture adjuster includes a guide plate attached to the rail and assembled so as to be movable relatively to the carriage, and the angle of the head fixing member is adjusted by changing the posture of the carriage relative to the guide plate.

4. The posture adjusting apparatus according to claim 2, wherein in the posture adjuster, a height adjuster that adjusts a height of the carriage with respect to the head fixing member is rotatable with respect to the carriage so that the angle of the head fixing member is adjusted.

5. The posture adjusting apparatus according to claim 2, wherein a hole to which the rail is inserted is formed at an upper portion of the carriage, and the posture adjuster allows an attachment angle of the carriage to be changed with respect to the rail once the carriage comes to the second position.

6. The posture adjusting apparatus according to claim 1, wherein the posture adjuster is operated after the ink ejector is moved to the second position.

7. An inkjet image forming apparatus, comprising:

the posture adjusting apparatus according to claim 1; and a conveyor disposed in a first position where an image is formed by the inkjet head, the conveyor conveying a recording medium.

8. The inkjet image forming apparatus according to claim 7, wherein a plurality of the ink ejectors are provided; and the posture adjusting apparatus is provided in each of the plurality of the ink ejectors.

9. The inkjet image forming apparatus according to claim 8, wherein each of the plurality of the ink ejectors is movable between the first position and a second position where the inkjet head is attached and detached.

10. The inkjet image forming apparatus according to claim 7, further comprising:

an enclosure that accommodates the conveyor and the ink ejector, wherein openings for operation are provided in walls of the enclosure located upstream and downstream in a direction of conveyance of the recording medium.

11. The inkjet image forming apparatus according to claim 9, wherein a receiver that receives ink dropping from the ink ejector is provided in the second position.

12. The inkjet image forming apparatus according to claim 10, wherein the openings are provided with a door for an operator to enter and exit.

13. The inkjet image forming apparatus according to claim 7, wherein the conveyor includes an image forming drum that conveys the recording medium while holding the recording medium on an outer peripheral surface.

14. The inkjet image forming apparatus according to claim 13, wherein the ink ejector includes a head fixing member to/from which a plurality of the inkjet heads are attached and detached, and the plurality of the inkjet heads are arranged on the head fixing member along an axial direction of the image forming drum.

15. The inkjet image forming apparatus according to claim 14, wherein the plurality of the inkjet heads are attached to the head fixing member in a plurality of rows along the direction of conveyance of the recording medium, the inkjet image forming apparatus further comprising:

an ink tank that supplies ink to the inkjet head, and an electric component that supplies a drive current to the inkjet heads, both above the plurality of the inkjet heads.

16. The inkjet image forming apparatus according to claim 15, further comprising:

an ink tube that supplies ink from the ink tank to the inkjet heads, wherein a change in flow path length due to the ink tube is avoided even when a posture of the ink ejector is adjusted by the posture adjuster.

17. The inkjet image forming apparatus according to claim 16, wherein a length of the ink tube is set so as to provide a droop when the ink ejector is in the first position.

* * * * *